United States Patent [19]

Abe

[11] 4,058,335

[45] Nov. 15, 1977

[54] MAGNETIC SHEET THE MAGNETIC ATTRACTION OF WHICH IS STRENGTHENED

[76] Inventor: Seiji Abe, 8-1-305, Fukuzumi 2-chome, Koto, Tokyo, Japan

[21] Appl. No.: 652,706

[22] Filed: Jan. 27, 1976

[51] Int. Cl.[2] ..... E05C 19/16

[52] U.S. Cl. ..... 292/251.5; 248/206 R; 248/206 A

[58] Field of Search ..... 292/251.5; 339/12 V; 248/206 A; 211/DIG. 1

[56] References Cited

U.S. PATENT DOCUMENTS

| | | | |
|---|---|---|---|
| 2,727,650 | 12/1955 | Moynihan et al. | 292/251.5 X |
| 2,967,038 | 1/1961 | Lennemann | 248/206 A X |
| 3,260,788 | 7/1966 | Stetson | 292/251.5 X |
| 3,325,639 | 6/1967 | King | 248;339/206 X;12 V X |
| 3,440,748 | 4/1969 | Hackley | 248/206 A X |

*Primary Examiner*—Richard E. Moore

*Attorney, Agent, or Firm*—Wenderoth, Lind & Ponack

[57] ABSTRACT

This invention relates to a means for strengthening the power of the magnetic attraction of a magnetic sheet, having a certain but weak magnetic attraction.

8 Claims, 29 Drawing Figures

MAGNETIC SHEET THE MAGNETIC ATTRACTION OF WHICH IS STRENGTHENED

BACKGROUND OF THE INVENTION

A magnetic attraction of a magnetic sheet measuring 6 cm by 6 cm and having a thickness of 0.25 cm can usually attract and hold a piece of metal or a metal base weighing at most, 125 grams by the attraction. The magnetic sheet forming a film is used in many fields such as a color sheet for a teaching material, various utensils and diverse apparatuses, because it is flexible. The magnetic attraction is, however, not powerful enough to attract and hold a heavy piece of metal, for the magnetic sheet forms a film. Therefore applications of the magnetic sheet are limited by its own character especially in the field where it is used for attracting and holding heavy materials such as industrial installations.

SUMMARY OF THE INVENTION

It is the object of this invention to provide a means for strengthening the magnetic attraction of a magnetic sheet having a weak magnetic attraction.

Another object is to provide the following mentioned utensils using such a strengthened magnetic sheet.

A further object of this invention is to provide a powerful magnetic sheet which does not make scratch marks on a surface of an attached metal base and which dose not clink noisily when the magnet is attached to a piece of metal or a metal base.

A further object is to provide a powerful magnetic sheet being flexible, freely slidable and beautiful at design.

A further object of this invention is to provide an economical magnetic sheet by saving the quantity used.

A further object is to provide a powerful magnetic sheet by making a vacuum part between a magnetic sheet and a piece of metal or a metal base.

Another object of this invention is to provide a powerful magnetic sheet capable of being applied in many fields even in a field where heavy materials are used.

BRIEF DESCRIPTION OF THE DRAWINGS

In the drawings,

In FIGS. 1 – 7, a magnetic sheet is generally indicated at 1. The central part of the magnetic sheet is generally indicated at 1*a*. The end parts of the magnetic sheet are generally indicated at 1*b*. A double-faced adhesive tape is generally indicated at 2. A mounting base is indicated at 3 and and a piece of metal 4 or a metal base 4 will be attracted by the magnetic sheet 1. An iron fragment or an iron sheet is shown at 5.

DETAILED DESCRIPTION OF THE PREFERRED EMBODIMENT OF THE PRESENT INVENTION

Figure 1:
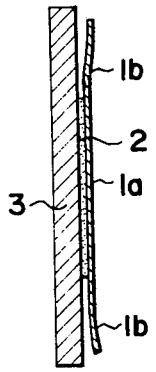
FIG. 1 is a cross section showing an embodiment of a magnetic sheet of this invention.
Figure 2:
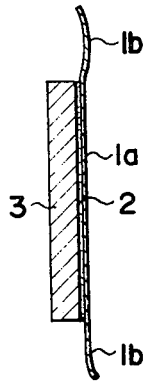
FIGS. 2 & 3 are cross sections illustrating other embodiments.
Figure 3:
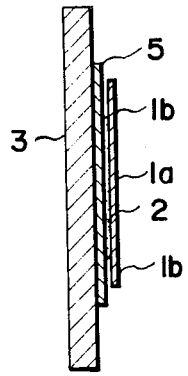

Referring to the figures of the drawings of the embodiments of this invention, in these figures, 1 is a magnetic sheet forming a film and the central part 12 of the magnetic sheet 1 is adhered to a mounting base 3 with a double-faced adhesive tape 2. Means for adhering them is not limited to just a double-faced adhesive tape as illustrated in the embodiment of FIG. 2, but any adhesive or a mounting fitting may be used. The end parts 1*b* of the magnetic sheet 1 and not the central part 1*a* are adhered to the tape and are in a flexible and free state from the mounting base 3 like an earlobe. It is alternative to use a thick magnet 3 used as a mounting base 3 has the same effect mentioned as follows. Another alternative to a mounting base 3 is an iron sheet 5.

Figure 4A:
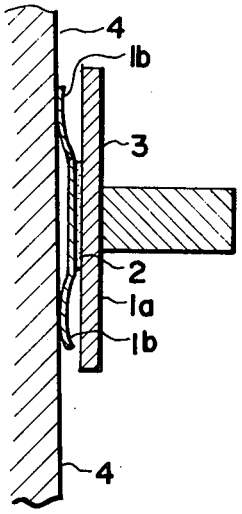
FIGS. 4(*a*) & 4(*b*) are cross sections illustrating an embodiment of the magnetic sheets applied to ones in practice.
Figure 4B:
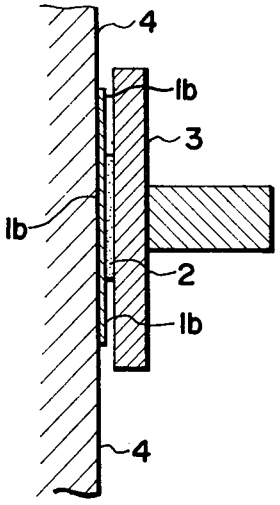

In the above mentioned construction of said invention, the end parts 1*b* of the magnetic sheet 1, being in flexible and free state from the mounting base 3, will begin to attach first to the piece of metal or metal base 4, then the central part 1*a* of the magnetic sheet 1 will attach to the metal base 4. While the magnetic sheet 1 is attaching to the base 4, the air between the magnetic sheet 1 and the metal base 4 will be eliminated so that the part between them will be in a vacuum state. The magnetic sheet 1 is, therefore, attached fast to the metal base 4 by the high air pressure, too. When the magnetic sheet is to be pulled from the magnetic attraction to said metal base 4, the central part of said magnetic sheet 1 will be taken off a little from the metal base 4 as shown in FIG. 4*a* of the drawings. The end parts 1*b*, however, will continued to be attached state to the metal base 4 because the magnetic attraction of the magnetic field by said magnetic sheet 1 will concentrate on the end parts 1*b* or the both poles of the magnetic sheet 1. Then the magnetic attraction at the end parts 1 will be strengthened like a horseshoe magnet. The strengthened parts 1*b* will not let air into the space between said magnetic sheet 1 and the metal base 4; therefore the air pressure at the outer side of the magnetic sheet 1 will also press the sheet 1 against the metal base 4 and the magnetic sheet 1 will be forced to stay on the metal base 4. In this embodiment, a magnetic sheet measuring 6 cm by 6 cm and having a thickness of 0.25 mm will attract and keep on attaching agains a heavy load weighing 5 k grams, whereas a magnetic sheet, which has the same dimensions as those above mentioned, without the end parts being flexible and free can only attract and keep on attaching against a load weighing 125 grams.

As it was described above, this invention had been completed by using characters of flexibility and the magnetic force of a magnetic sheet. The magnetic attraction of a magnetic sheet is strengthened so much that even a heavy load on the magnetic sheet can be held fast against the magnetic attraction. Applications for the magnetic sheet are, therefore, enlarged.

Figure 5:
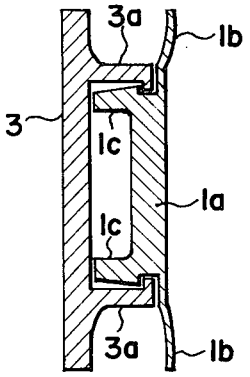
FIGS. 5, 6, 7(*a*) & 7(*b*) are cross sections showing other embodiments.
Figure 7A:
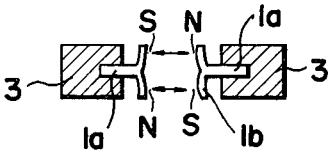
Figure 7B:
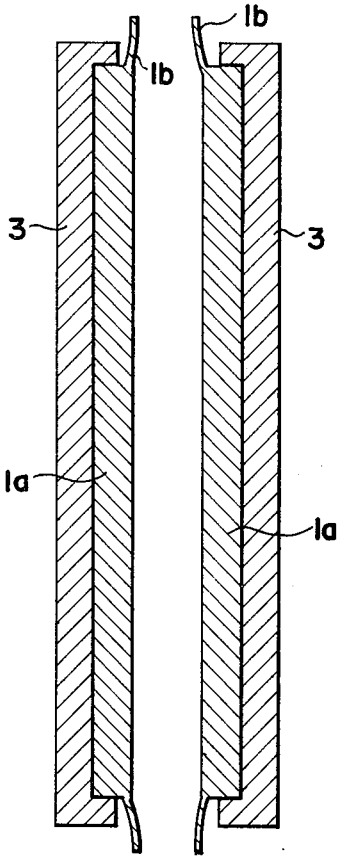
Figure 6A:
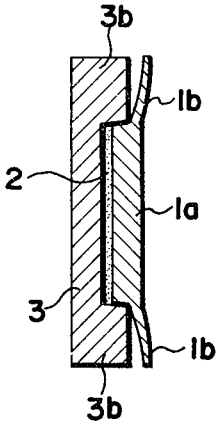
Figure 6B:
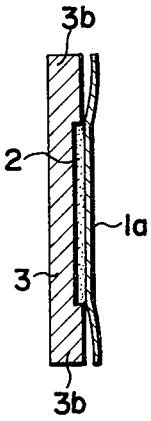

Other embodiments of this invention is shown in FIGS. 5 – 7 of said drawings, where the above mentioned means adhering the magnetic sheets and mounting bases are shown as alternatives. In FIG. 5 of the drawings, a thick magnetic sheet has two protuberances 1*c*, at the parts between the central 1*a* and the end parts 1*b*, expanding to a mounting base which has two hooks 3*a* fitting said protuberances 1*c*. The thick magnetic sheet is attached fast to the metal base 3 by means of the protuberances 1*c* and the hooks 3*a* instead of an adhesive tape, and as shown in FIG. 6, the mounting base 3 has the thick part 3*b* and an indented part, and a double-faced adhesive tape 2 or similar adhesive in the indented part of said mounting base 3. The central part 1*a* of a magnetic sheet is adhered to the mounting base 3 by the adhesive 2. If the central part 1*a* of the magnetic sheet is thick enough to fit the indented part of the mounting base 3, the magnetic sheet will be adhered to the mounting base 3 faster. As shown in FIGS. 7(*a*) & 7(*b*) of the drawings, the central part 1*a* of a magnetic sheet, projecting towards a mounting base 3, is held fast in the indented part of the mounting base 3, and the end parts 1*b* are left in a flexible and free state like those of other embodiments.

The embodiment shown in FIG. 5 of the drawings can be applied widely to ones in field such as an accordion curtain because adhesive is not used in order to mount a magnetic sheet on a mounting base 3, however such a magnetic sheet 1 is mounted fast on the mounting base 3. The embodiment shown in FIG. 6(*a*) of the drawings can be also applied widely, to because the central part 1*a* of the magnetic sheet is thick, which will endure chemical change by the adhesive, while it is mounted fast on said mounting base 3. The embodiments shown in FIGS. 7(*a*) & 7(*b*) of the drawings are suitable to being in fields such as fasteners which are used as a pair. And a plurality of magnetic sheets of this invention as shown in FIG. 8 of said drawings will enlarge its applications to ones in many fields.

The following are examples of products applied to the following embodiments.

Figure 8:
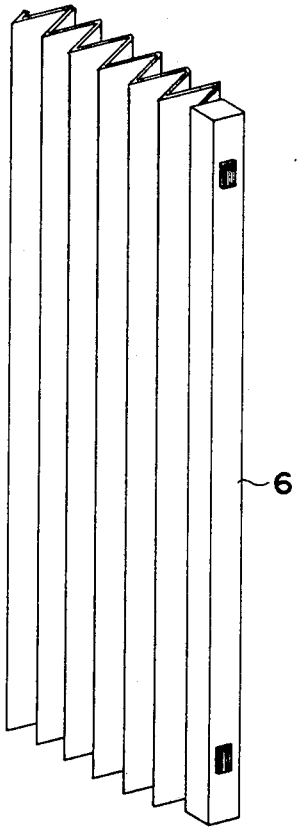
FIGS. 8, 9, & 10 are perspective views of an embodiment of said invention applied to an accordion curtain.
Figure 9:
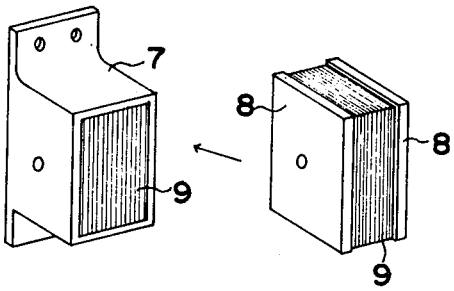
Figure 10:
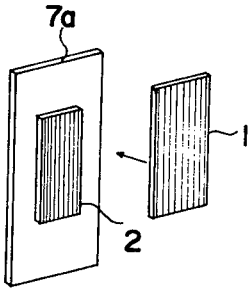

FIGS. 8–10 of the drawings, illustrate an example of an accordion curtain to which the magnetic sheet of this invention is applied. With a conventional accordion curtain, a plastic case 7 is plugged in a certain part of a curtain frame 6, and a magnet 9, the magnetic attraction of which is concentrated with catcher yokes 8, is inserted thereinside. The embodiment of this invention is simple and economical as above mentioned. (The central part of a magnetic sheet 1 is attached fast to a plastic mounting base 7*a* fastened to a frame of an accordion curtain.) By not employing metal such as catcher yokes 8, the magnetic sheet 1 of this invention will not clink noisily and will not make scratch marks on a surface of the attracted metal or metal base when it is attracted into engaged relationship. Besides, when a corted steel pole or a frame is used, the catcher yokes hurt the corting. Catcher yokes rust, and said magnetic sheet is easily colored and shaped nicer. The frame of an accordion curtain is not required to be thick because such magnetic sheet may thin, therefore the frame is also be shaped thinner, have a nicer design and be more functional.

Figure 11:
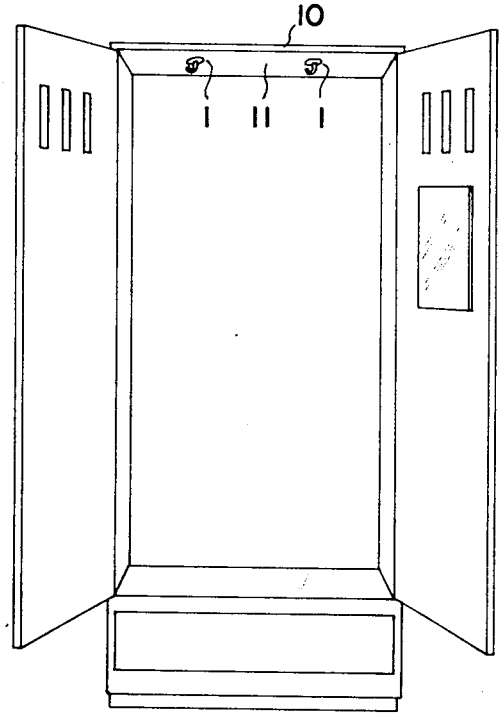
Figure 12:
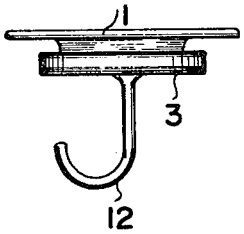
Figure 13:
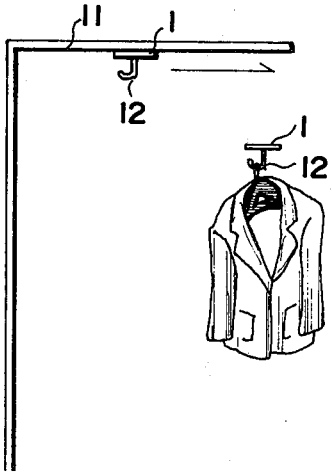

FIGS. 11 – 13 of the drawings illustrate a slidable hanger with regard to this invention.

The central part of a magnetic sheet 1 is fastened to a mounting base 3 having a hanger hook 12. The magnetic force or attraction of such magnetic sheet 1 attracts an ordinary magnetic sheet 11 adhered to the inner side surface of the upper side of a wardrobe 10. The magnetic attraction between them holds a hanger holder having the mounting base 3 and the hanger hook 12. The hanger holder is easy to slide on the surface of the ordinary magnetic sheet 11, whereas it is strong enough to attract and hold against a heavy load on the hanger holder. This application of this invention, therefore, has a merit in terms of use, because said magnetic sheet 1 of said hanger holder is easily attached anywhere on the surface of an ordinary magnetic sheet 11 of the wardrobe 10. It is easily attached to and taken from the surface of the ordinary magnetic sheet 11 of the wardrobe 10, since it need only to be put on the surface when it is desired to be attached and it has only to be slid to a non-metal part of the wardrobe 10 or an end part of said magnetic sheet 1 of this invention in order to disengage when it is to be removed.

FIGS. 14 – 18 of the drawings illustrate other embodiments of this invention applied in fields of building and so on such as interior decorations.

Figure 14:
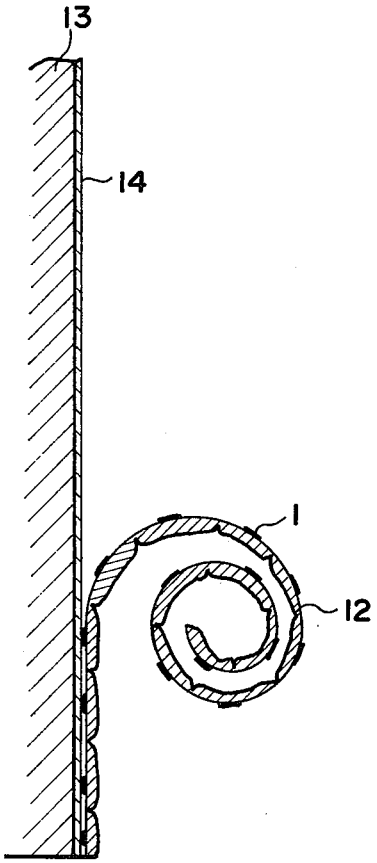
FIGS. 14 – 23 illustratively show other embodiments applied to interior decorations.
Figure 15:
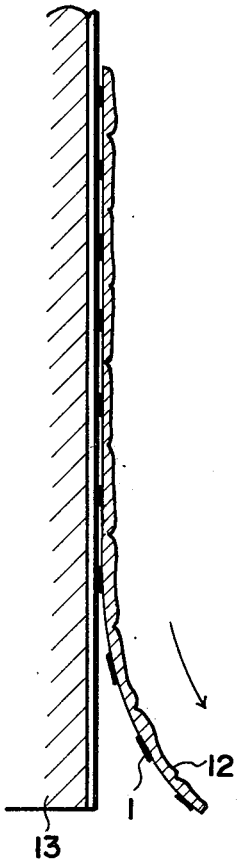
Figure 16:
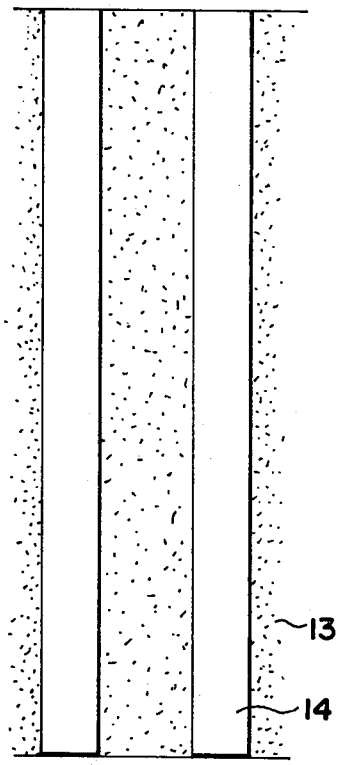
Figure 17:
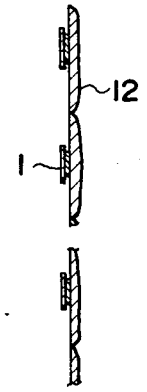
Figure 18:
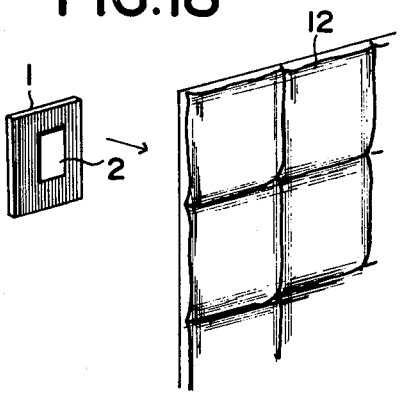
Figure 21:
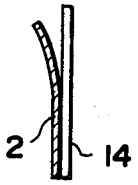
Figure 22:
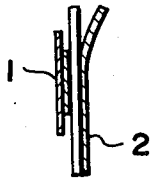

The central parts of the magnetic sheets 1 of this invention are adhered to or attached to a decoration sheet 12 as illustrated in FIGS. 17 & 18. A steel base 14 mounted on a wall 14 is attracted by the magnetic sheet 1. The decoration sheet 12 having the magnetic sheet 1 of this invention is easily engaged with and disengaged from said steel base 14 mounted on the wall 13, because it has only to be rolled off in order to engage, from the lower side to the upper side as illustrated in FIG. 14 and it has only to be pulled down in order to disengage, from the lower side as illustrated in FIG. 15 because it is easily slid. As illustrated in FIGS. 14 and 16 of the drawings, the steel bases 14 the thicknesses of which are approximately 0.1 mm, are partially mounted on the wall and the decoration sheet 12 having the magnetic sheets 1 of said invention attract and hold the sheet 12. Further, the means 2 attaching the magnetic sheet 1 fastened to the steel base 14 is alternative to any other such as a double faced adhesive tape or adhesive as mentioned above. Another alternative is to attach the central part of the magnetic sheet 1 to the wall 13 and mount the steel base 14 on the decoration sheet 12.

Figure 23:
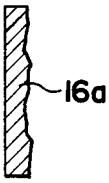
Figure 19:
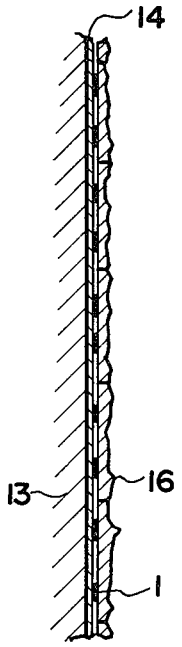
Figure 20:
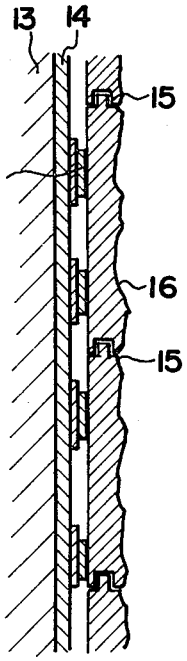
Figure 24A:
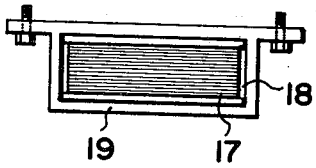
FIGS. 24 – 28 illustrate other embodiments applied to doors of a wardrobe.
Figure 24B:
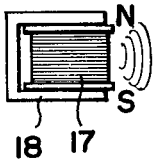
Figure 25:
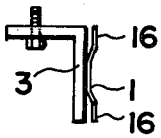
Figure 26:
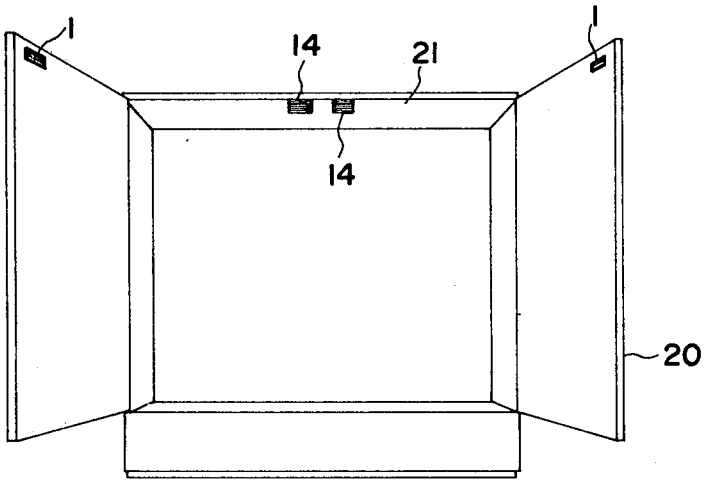
Figure 27:
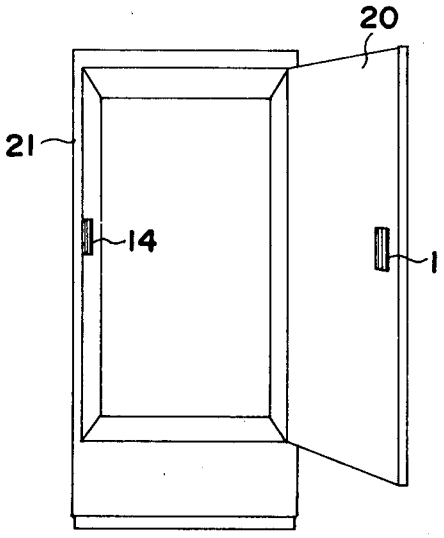
Figure 28:
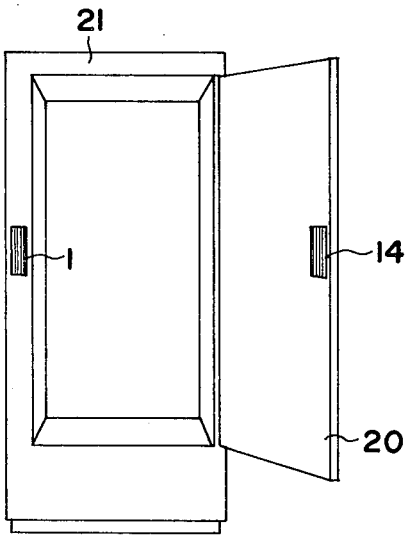

When the decoration sheet is a hard board such as a decoration panel 16, the decoration panel 16 is attached as illustrated in FIGS. 19 – 23 of the drawings. Several panels 16 having magnetic sheets 1 of said invention attached to steel bases 14 mounted on a wall 13 are put side by side as illustrated in FIGS. 19 & 20. A panel having a convexity on one side hereof and a concavity on the other side hereof as illustrated in FIG. 20 is an alternative to this. With these decoration panels 16, it is suitable to have a set composed of a steel mounting base 14 having a double-face adhesive tape 2 (FIG. 21), a mounting base having a magnetic sheet 1 of this invention and a double-face adhesive tape (FIG. 22), and a decoration panel 16*a* (FIG. 23).

FIGS. 24 – 28 illustrate an embodiment applied to a clasp of a wardrobe. Conventionally, a magnetic clasp having a magnet 17 mounted in an iron yoke in order to concentrate the magnetic attraction of the magnet 17, is inserted and fastened in a plastic case 19 screwed to a wardrobe. This conventional magnetic clasp has the same inferior points as the magnetic clasp or a pair of fasteners applied to said accordion curtain mentioned above. A unit of a magnetic sheet clasp, which is composed of said magnetic sheet 1 of this invention, the adhesive tape, and the metal mounting base 14, screwed to a door 20 and the upper side 21 of a wardrobe work better.

Figure 29:
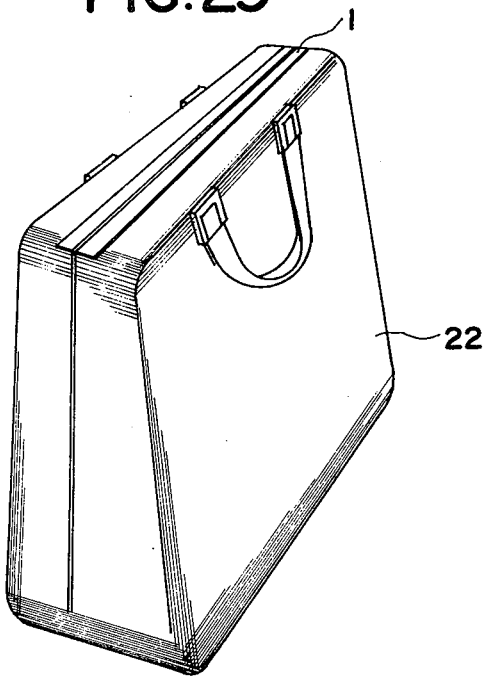
FIG. 29 is a perspective view of an embodiment applied to a bag.

FIG. 29 illustrates an embodiment applied to bags, suitcases and so on.

Said magnetic sheet 1 of this invention is used here as a pair of fasteners of a bag 22. Magnetic attraction and air pressure by vacuum, are utilized here too. A magnetic sheet, the dimension of which 6 cm × 6 cm × 0.5 cm, can attract and hold a heavy load weighing approximately 4 – 5 kilograms, whereas an old magnetic sheet of the same dimensions can only hold a light load weighing at most 100 – 130 grams. Said magnetic sheet 1 is easily slid by a force pressing horizontally by pressure of 150 – 200 grams, whereas a conventional gum sucker is impossible to slide, besides it has to be pressed when it is attached in order to engage and said magnetic sheet 1 of this invention is easy to engage because of the magnetic attraction. The magnetic sheet is flexible as mentioned above, therefore a steel base which will be attracted by the sheet 1 is not required to be flat, and since the magnetic sheet 1 has a magnetic attraction as mentioned above, unlike a gum sucker, it keeps on attaching to a steel mounting base forever.

I claim:

1. A magnetic sheet comprising:

a mounting base; and magnetic sheet means attached at the central portion thereof to one side of said mounting base for attracting said mounting base to a magnetically attractive surface, the ends of said magnetic sheet around said central portion being flexible and free from said mounting base.

2. A magnetic sheet as set forth in claim 1, wherein said central part is attached to an iron sheet placed between said magnetic sheet and said mounting base.

3. A magnetic sheet as set forth in claim 1, wherein said central part is fastened to said mounting base with means which are between said central part and said end parts, and which fit in said mounting base and hold it.

4. A magnetic sheet as set forth in claim 1, wherein it is applied to a pair of fasteners attracting each other, the central part of said fasteners, which are the magnetic sheets, being fit fast in the mounting base with a holder hereof.

5. A magnetic sheet as set forth in claim 1, wherein said mounting base attached fast to said magnetic sheet has a hanger hook, said magnetic sheet being easy to be slid on an attracted matter.

6. A magnetic sheet as set forth in claim 1, wherein the central part of said magnetic sheet is adhered to an interial decoration sheet, said magnetic sheet attracting a metal base mounted on a wall.

7. A magnetic sheet as set forth in claim 1, wherein the central part of said magnetic sheet is attached fast to a wall, said magnetic sheet attracting a metal base mounted on an interial decoration sheet.

8. A magnetic sheet as set forth in claim 1, wherein said magnetic sheet is mounted on a portion of a thing with one being able to open such as a wardrobe with the door or a bag, and the symmetrical portion of which having an attracted metal or a metal base.

* * * * *